United States Patent [19]

Roesch et al.

[11] Patent Number: 4,951,831

[45] Date of Patent: Aug. 28, 1990

[54] ECOLOGIST FLEXIBLE TRASH BAG RECEPTACLE

[76] Inventors: James F. Roesch; Charleen B. Roesch, both of 10441 Variel Ave., Chatsworth, Calif. 91311

[21] Appl. No.: 483,390

[22] Filed: Feb. 22, 1990

[51] Int. Cl.[5] ..... B65B 67/12

[52] U.S. Cl. ..... 220/1 T; 220/401; 220/404; 220/18; 248/97; 248/99; 141/390; 141/391; 141/316; 141/98

[58] Field of Search ..... 141/390, 391, 316, 114, 141/98; 220/1 T, 85 B, 401, 404, 403, 18.1; 248/97, 99

[56] References Cited

U.S. PATENT DOCUMENTS

| | | | |
|---|---|---|---|
| 792,197 | 6/1905 | Clark | 248/97 |
| 1,421,628 | 7/1922 | Watkins | 220/401 |
| 1,643,407 | 9/1927 | Florance | 220/401 |
| 1,879,410 | 9/1932 | Morris et al. | 141/390 |
| 3,958,785 | 5/1976 | Aboud | 248/97 |
| 4,140,257 | 2/1979 | Peterson | 220/404 |
| 4,203,479 | 5/1980 | Mathews | 220/401 |
| 4,280,315 | 7/1981 | Von Hapsburg | 141/390 |
| 4,558,796 | 12/1985 | Jaicks | 220/1 T |
| 4,757,966 | 7/1988 | Harris | 141/390 |
| 4,874,141 | 10/1989 | Schulz | 248/99 |

*Primary Examiner*—Stephen Marcus
*Assistant Examiner*—S. Castellano

[57] ABSTRACT

An improved plastic trash receptacle to support a plastic trash bag, expanding to admit approximately a maximum capacity of trash. A plurality of slots (10), are molded into the lower circumference of a receptacle (28), resulting in an equal number of flexible side panels (12), incorporating a reinforcement bead (34), along the edge of each side, and ends of slots. The panels bulge outwardly as trash is compacted into the plastic trash bag (22), figure (8). The bulging panels result from expanding slots (36). After a filled bag is securely closed, it may be lifted from the receptacle. If the receptacle lifts with the bag, the user places his toes over the hand toe grips (14), to keep the receptacle on the supporting surface while lifting the bag therefrom. If the filled bag is excessively heavy, the user tips the receptacle upside down, containing the securely closed bag. Again, utilizing the hand toe grips (14), the user lifts the lightweight receptacle from the filled bag. Thereby, gravity is enlisted as an ally instead of a foe. Dolly wheels (16), may be incorporated on some models, mounted on an axle (26), supported by wheel mounting flanges (18), molded as part of the receptacle. All weather provisions include a lid, figure (6), and optional drain knockouts (24). About three knockouts will be imprinted only, into the bottom of every receptacle, and may be removed by user as deemed necessary. Standard upper handles (20), will be molded to each receptacle.

4 Claims, 2 Drawing Sheets

ECOLOGIST FLEXIBLE TRASH BAG RECEPTACLE

BACKGROUND—FIELD OF INVENTION

This invention relates to the collection of trash for disposal, through the use of plastic or steel trash receptacles and plastic trash bags.

BACKGROUND—DISCUSSION OF PRIOR ART

Heretofore, the collection of a families trash usually required more than one trash receptacle.

Since the introduction of the plastic trash bag, fewer receptacles are necessary as refuse is now disposed of in non returnable bags, in many cases.

As a result of this development, the use of plastic trash bags held open by rigid steel or semi-rigid plastic receptacles has resulted in an under utilization of the maximum capacity of the bags. This is because the current models of receptacles prevent expansion of the bags.

Some forms of specialized plastic trash bag holders do allow for filling the bags closer to maximum capacity. However, great care must be exercised to prevent prematurely pulling the bag from the holder, or tearing the bag, thus necessitating starting over. Examples are 289,935 to Pasca, 1984, and 4,783,031 to Ebentheuer, 1987. Additionally, other models of the holders are relatively unstable and delicate in nature. Example, 271,718 to Johno and Johno, 1981. These types of holders may result in damaging the bags beyond use, thus wasting a natural resource item, and related secondary resources used for manufacturing, such as fuel and water. Additionally, they have limited applications primarily for light weight materials, loosely packed.

OBJECTS AND ADVANTAGES

The object and advantage of this invention is a positive step for conservation of natural resources. It permits plastic trash bags to be filled to approximately maximum capacity. This results in fewer bags being used. Therefore, less oil is required to produce plastic bags. This contrast prior art.

This method often requires one receptacle instead of many. This contrasts to prior art by reducing consumption of oil and steel, from which receptacles are currently manufactured.

Use of this invention will also reduce consumption of secondary natural resources needed for manufacturing. The secondary resources used for manufacturing all of the aforementioned receptacles and bags are fuel and water.

This receptacle may possibly be manufactured from recycled plastics. (See "Newsweek", Nov. 27, 1989, page 71, colum 3) This receptacle may be recycled when it becomes unusable.

The quality of the environmental appearance will be enhanced. This is accomplished by the by elimination of empty unsightly, and unnecessary trash receptacles waiting to be emptied, then removed from trash pickup locations.

Additionally, time and effort is conserved when fewer bags need to be transported to the pickup location. The same is true by eliminating empty receptacles to be returned from the pickup location. Also, by eliminating dirty unhealthy receptacles, time, effort, and water are conserved by eliminating occasional hosing out.

This invention saves the users time and labor by eliminating the need of venting air trapped between the bag and receptacle. This is accomplished by the air exiting thru the slots during trash filling operations, in contrast to prior art.

In addition, time and labor is saved by enabling the bag to be filled quicker and easier. This is permitted by the rugged, sturdy nature of the modified plastic trash receptacle. Again, in contrast to prior art.

This method can help eliminate safety hazards. The hazards are empty receptacles blowing about in wind storms, endangering people, animals and property.

This invention is versatile The receptacle is intended to be manufactured in at least two models. The first will incorporate dolly wheels, to be mobile This model will be easier for elderly, small, or handicapped persons to use. The second model will not have dolly wheels. However, both models will have two upper handles, as is common throughout the industry.

Although many methods exist for filling plastic trash bags, neither standard receptacles or specialized holders offer the ecological or human resource conservation of this improved invention.

REFERENCE NUMERALS IN DRAWINGS

| | |
|---|---|
| 10 slots | 12 flexible side panels |
| 14 hand toe grips | 16 dolly wheels |
| 18 wheel mounting flanges | 20 upper handles |
| 22 plastic trash bag | 24 optional drain knockouts |
| 26 dolly axle | 28 lower side of receptacle |
| 30 connecting radius | 32 bottom of receptacle |
| 34 reinforcement beading | 36 expanded slots |
| 38 compacted trash | |

DESCRIPTION OF INVENTION

Figure 1:
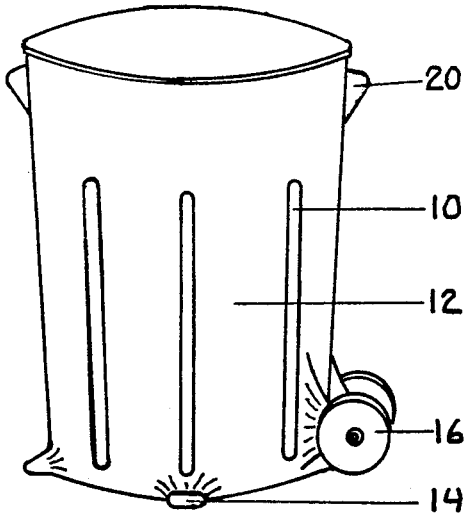
FIG. 1 is a perspective view of an empty flexible trash bag receptacle showing upper handles, slots, flexible side panels, dolly wheel assembly, and hand toe grips.

FIG. 1 shows an overall static view of The Ecologist Flexible Trash Bag Receptacle. The first embodied improvement is a set of slots 10. Each slot is approximately 18 mm wide by 47 cm long, concluding in half rounded ends, also shown in FIGS. 4 and 5. The slots create a set of flexible side panels 12. The second improvement is shown at the bottom of the receptacle, a set of hand toe grips 14. In addition to the aforementioned improvements, a set of dolly wheels 16, are shown for this model. The dolly wheels will be incorporated on about half of the receptacles at the time of manufacture. The dolly assembly will be manufactured using state of the art procedures and materials. A pair of upper handles 20, are seen below the top of the receptacle.

Figure 2:
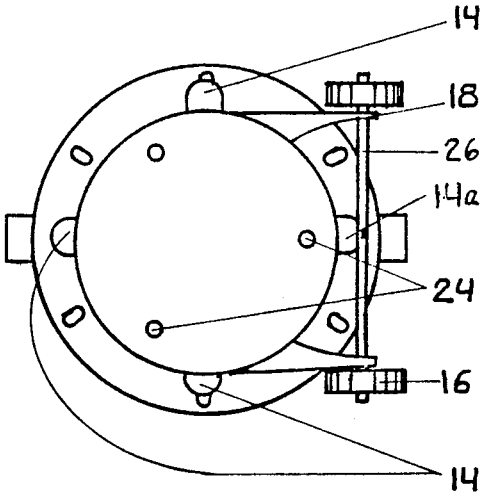
FIG. 2 is a bottom upside down view showing same details as FIG. 1, plus optional drain knockouts.

FIG. 2 is an upside down view of the bottom of the receptacle. This shows the layout of the four hand toe grips 14, located 90 degrees from each other. Note, one grip 14*a*, is located between the dolly wheels 16. Also shown is a pair of wheel mounting flanges 18, a dolly axle 26, and a set of optional drain knockouts 24.

Figure 3:
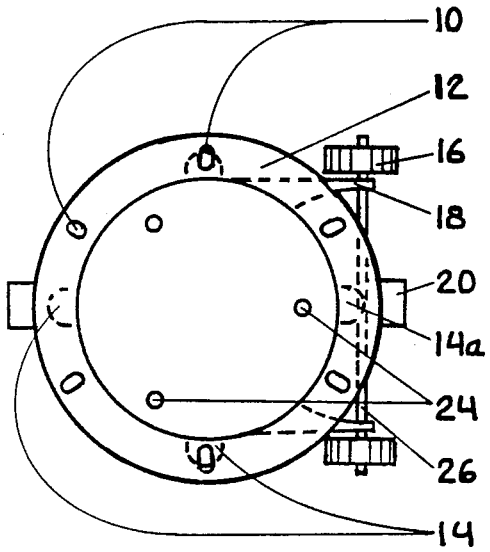
FIG. 3 is a top view looking down into empty receptacle.

FIG. 3 is a top view looking down into the receptacle. All the specifics numbered and identified above are also shown in this view. The three optional drain knockouts 24, are to be approximately 12 mm in diameter and imprinted only, during the molding process. The user will have the option of leaving them intact or removing them.

Figure 4:
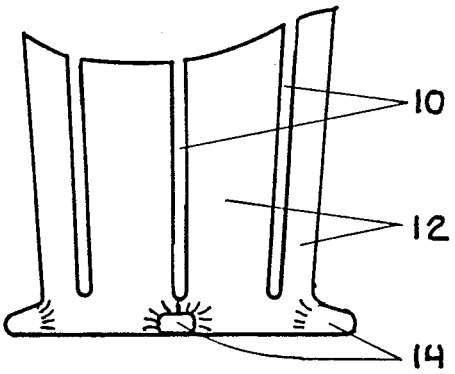
FIG. 4 is a front, lower sectional view showing the slots, flexible side panels, and hand toe grips.

FIG. 4 shows a front view detailing the molded design of three of the four hand toe grips 14. Also shown are the slots 10, and the flexible side panels 12.

Figure 5:
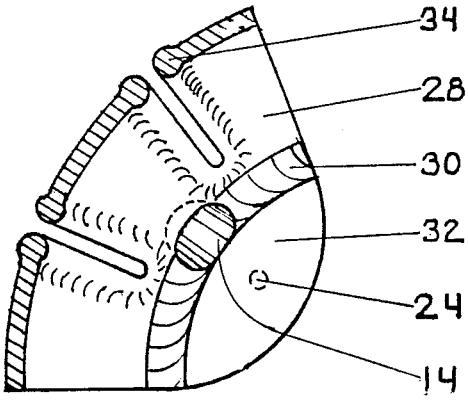
FIG. 5 is sectional view showing the reinforcement beading along the edges of the flexible side panels, the radius connecting the side to the bottom, an inside view of a hand toe grip, and an optional drain knockout in the bottom.

FIG. 5 is a sectional view of a reinforcement beading 34. Also shown are parts of three lower sections of side panels 28, the connecting radius 30, and the bottom of the receptacle 32. Additionally, one of the three optional drain knockouts 24, and one of four hand toe grips 14 is shown.

Figure 6:
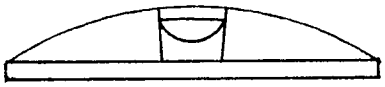
FIG. 6 shows a lid for all weather use, as is standard through out the industry.

FIG. 6 shows an example of a standard trash receptacle lid, common to the industry. Each receptacle shall include one lid.

Figure 7:
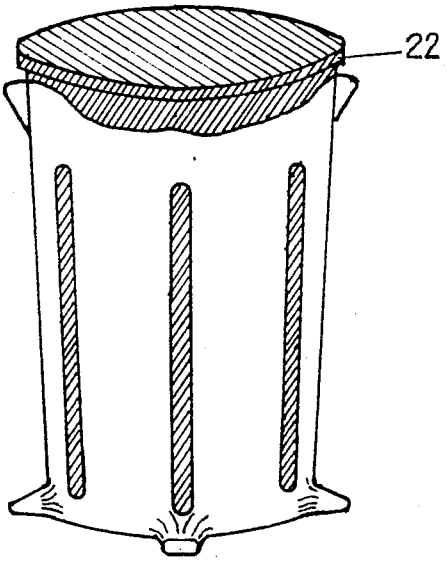
FIG. 7 is a static, perspective view of a flexible trash bag receptacle, containing an empty plastic trash bag.

FIG. 7 is a static, perspective view of the Ecologist Flexible Trash Bag Receptacle, with a plastic trash bag 22, in place ready for operations. Note, this model does not incorporate dolly wheels.

Figure 8:
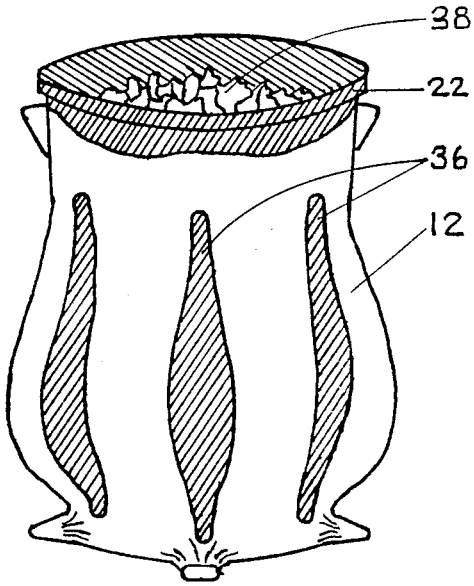
FIG. 8 is a dynamic, perspective view of a flexible trash bag receptacle, and bag filled with trash, causing the flexible side panels to bulge outwardly due to pressure from compacting trash.

FIG. 8 is a dynamic, perspective view of the receptacle in use. A plastic trash bag 22, is shown folded over the top of the receptacle In addition the bag may be seen thru the expanded slots 36. This expansion is caused by compacted trash 38, forceing the flexible side panels 12, to bulge outwardly.

OPERATION OF INVENTION

This invention relates to efficiency of trash disposal. Specifically, it enables the user to fill a plastic trash bag with more trash, quicker and easier than prior art. Thus, natural resources are conserved, and time, energy, and money are saved. These claims will be accomplished by improved embodiments incorporated into an approximately 122 liter trash receptacle, standard throughout the industry. The improvements will be incorporated at time of the manufactures molding process. The improvements have a much broader scope than trash alone.

The first of the improvmements are a set of approximately six slots 10, about 18 mm wide by 47 cm long. Thereby dividing approximately ⅔ of the lower side of a receptacle 28, into a set of flexible side panels 12, equaling the number of slots. Each slot 10, has half rounded ends between each flexible side panel 12. See FIGS. 1, 4, and 5. The half rounded ends of the slots provide greater flexibility and longevity for the receptacle.

The user starts by inserting a plastic trash bag 22, into the receptacle. After folding the top of the bag over the top of the receptacle, to hold the bag secure, filling may begin. See FIG. 7. Note, there is no need to vent trapped air from between the bag and receptacle. The air vents thru the slots 10, during the trash filling operation. As the bag fills with trash 38, the slots 10, begin to expand 36. This is caused by internal pressure from manually compacting the trash. This expansion results from the flexible side panels 12, bulging outwardly. See FIG. 8. When the compacted trash 38, reaches approximately 150 mm from the top of the receptacle, filling should stop.

The bag is now filled to approximately maximum designed capacity. The user next securely closes the bag. This is accomplished by various means provided by different bag manufactures. All methods used with this invention worked satisfactorily. Next comes the removal of the filled bag from the bulging, flexible receptacle. See FIG. 8.

Removal is accomplished by lifting the closed, filled bag 22, out of the receptacle The effort required is determined by how tightly the trash is compacted. If the bag is filled using average compaction, it will lift out easily. This is especially true when lightweight materials are used. These materials may be dry leafs, weeds, or household trash, etc. However, if the filled bag tends to lift the lightweight plastic receptacle, a simple solution exist. The user need only place his or her toes over a pair of hand toe grips 14. The user next lifts the bag, while holding the receptacle to the ground with toe pressure. Thus Permitting the bag to slide easily out of the receptacle.

However, if the plastic trash bag 22, is filled with heavy materials, the bag may be too difficult to lift. The heavy materials may be fresh grass clippings or other damp or wet trash. Again, a simple solution exist. After the bag is securely closed, the user simply tips the receptacle upside down. Using the hand toe grips 14, again, the user lifts the lightweight receptacle. The filled bag, being heavier than the receptacle, slides easily therefrom. Thus, we have turned gravity into an ally instead of a foe.

The slots 10, provide the primary improvement of this invention, that is the flexible side panels 12. Therefore, a reinforcement beading 34, has been designed for added durability. The beading is to be molded along both edges of all the panels. See FIG. 5. The diameter of the molded reinforcement beading 34, should be approximately twice the thickness of the side panels 12. The shape of the beading will be approximately round except where connected to the panels. The beading will aid the receptacle to resist cracking and tearing, and help prevent snagging a plastic trash bag 22, seen thru the expanded slots 36. See FIG. 8.

To aid in mobility, this inventor intends at least two models of these receptacles to be manufactured. The first model will incorporate a set of dolly wheels 16. The wheels will be attached by a pair of wheel mounting flanges 18, and will incorporate a steel axle 26, or equivalent material. The flanges will be molded, using same material as the receptacle, Possibly reinforced, at time of manufacture. The wheels shall be what is common to the industry. The first model will be easier for elderly, small, or handicapped persons to use.

The second model will be without dolly wheels. This model may be moved by using a pair of upper handles 20, standard throughout the industry. Note, all models will incorporate two upper handles.

To maintain versatility, provisions for all weather use are incorporated. A water proof lid, FIG. 6, as is standard throughout the industry shall be provided for every receptacle of every model. Additionally, a set of about three optional drain knockouts 24, will all be imprinted in the bottom of all receptacles 32, at the time of manufacture. The knockouts may be easily removed by using a screwdriver or similar tool. The user may remove as many knockouts as deemed necessary. The arrangement of these knockouts will be next to the lower terminus of the connecting radius 30. The radius 30, connects the sides of receptacle 28, to the bottom of receptacle 32. See FIGS. 2, 3, and 5. These drains will enable rainwater or other liquids to exit the receptacle only. Any fluids inside the plastic trash bag will remain trapped.

Thus, this invention may be used as any similar trash receptacle, as is standard throughout the industry. If several days accumulation of trash are required to fill the receptacle, the lid should be used. The lid will help prevent odors from escaping or flies from entering. During operation, inclement weather will not interfere with the receptacles efficient use. Any rainwater seeping thru the slots may simply drain out, thru the optional knockouts.

The sucess of this invention depends largely on the flexible side panels. Therefore, consideration may be given to the durability of the material used to make the receptacle. Many breakable plastics exist. Likewise many flexible plastic compounds exist that withstand repeated flexing. Examples are hinges used on plastic trash receptacles, some cabinet hinges, and marine use. The preferred compound will provide the optimum durability for repeated flexing of the side panels.

CONCLUSION, RAMIFICATIONS, AND SCOPE OF INVENTION

Thus the reader can see that The Ecologist Flexible Trash Bag Receptacle provides an ecologically and economically sound, lightweight, easy to use, and highly efficient means of disposing of trash.

The above description contains many specifics that should not be construed as limitations on the scope of this invention. Rather, they should be viewed as an exemplification of one preferred embodiment thereof. Many additional variations are possible. For example, the receptacle may be made larger or smaller to accommodate various sizes of plastic trash bags. These receptacles may vary in shape; rectangular, square, hexagonal, etc. The receptacle may incorporate three or four caster wheels, instead of two, or no dolly wheels. These wheel variations can accommodate various surface and use conditions. The number of hand toe grips may vary. The number and or size of slots may vary, for greater or less flexibility. This invention may be used for purposes other than trash, such as clothing or bedding hampers in hospitals, hotels and the like. The receptacles may be placed inside an enclosure to enhance appearance for public or private use. The enclosure may be used with or without restricting, funnel type lids. The principal of efficient flexibility, discussed previously remains constant. Undoubtedly additional uses exist.

Accordingly, the scope of this invention should not be determined by the embodiments illustrated, but by the appended claims and their legal equivalents.

What is claimed is:

1. A flexible trash receptacle, improved to enable filling of a plastic trash bag liner to its approximate maximum designed capacity wherein:

said receptacle comprises a circumferential sidewall, a closed bottom and an open top with a continuous circular rim, for holding an open mouth of said trash liner when placed inside said receptacle, said circumferential sidewall having a plurality of vertically extending slots spaced at regular intervals about the circumference of the sidewall, resulting in an equal number of reinforced flexible side panels, which are rigid enough to support the sidewall in an upstanding configuration when said trash liner is empty, yet are flexible enough to expand outwardly when said trash liner is filled and compacted to said maximum design capacity.

2. The trash receptacle of said claim 1 further comprising: combined hand toe grips extending outwardly from the bottom of said receptacle for aiding in the removal of said trash liner in both upright and upside down orientations of said receptacle.

3. The trash receptacle of said claim 1 is manufactured from plastic.

4. The trash receptacle of claim 1 is manufactured from rubber.

* * * * *